US008988010B2

(12) United States Patent
Suzuki

(10) Patent No.: US 8,988,010 B2
(45) Date of Patent: Mar. 24, 2015

(54) LED DRIVING DEVICE AND LIGHTING DEVICE

(71) Applicant: Minebea Co., Ltd., Kitasaku-Gun, Nagano (JP)

(72) Inventor: Shinichi Suzuki, Hamamatsu (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 14/087,069

(22) Filed: Nov. 22, 2013

(65) Prior Publication Data

US 2014/0176015 A1 Jun. 26, 2014

(30) Foreign Application Priority Data

Dec. 20, 2012 (JP) ..... 2012-278139

(51) Int. Cl.
*H05B 37/02* (2006.01)
*H05B 33/08* (2006.01)

(52) U.S. Cl.
CPC ..... *H05B 33/0803* (2013.01)
USPC ..... 315/307; 315/224; 315/247

(58) Field of Classification Search
CPC ..... H05B 33/0815; H05B 33/0848; H05B 37/02; H05B 39/04; H05B 41/36
USPC ..... 315/209 R, 224–226, 247, 291, 297, 315/307, 308
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 8,339,053 | B2 | 12/2012 | Yamasaki et al. | |
| 8,339,063 | B2 * | 12/2012 | Yan et al. | 315/291 |
| 2012/0262080 | A1 * | 10/2012 | Watanabe et al. | 315/210 |

FOREIGN PATENT DOCUMENTS

JP 2009-123681 A 6/2009

* cited by examiner

*Primary Examiner* — Tung X Le
(74) *Attorney, Agent, or Firm* — Carrier Blackman & Associates, P.C.; Joseph P. Carrier; Jeffrey T. Gedeon

(57) ABSTRACT

An LED driving device that performs a dimming operation of an LED module, the device includes: a dimming controller that receives the dimming instruction signal and generates a dimming signal; and a driving circuit that supplies an output current to the LED module based on the dimming signal generated by the dimming controller, wherein the driving circuit unit includes: a converter controller that generates a drive signal based on the dimming signal and outputs the drive signal to a first switching element; a first current setting circuit; and a second current setting circuit that is connected in parallel to the first current setting circuit, and wherein the dimming controller controls an operating state of the second current setting circuit to switch an adjustment range of the output current and a change characteristic of the output current in response to the dimming signal.

9 Claims, 7 Drawing Sheets

LED DRIVING DEVICE AND LIGHTING DEVICE

CROSS-REFERENCE TO RELATED APPLICATION

This application claims priority from Japanese Patent Application No. 2012-278139 filed on Dec. 20, 2012, the entire subject matter of which is incorporated herein by reference.

TECHNICAL FIELD

This disclosure relates to an LED driving device and a lighting device. Specifically, it relates to an LED driving device and a lighting device that are capable of dimming of an LED module.

BACKGROUND

In recent years, in lighting devices, an LED module configured by a plurality of LEDs (light emitting diodes) is used as a light source, and there is known an LED driving device that performs lighting by dimming-controlling of the LED light source.

Such an LED driving device is described, for example, in JP-A-2009-123681. Specifically, the LED driving device is provided with a constant current circuit having a switching element, and the LED driving device supplies an LED current to the LED module to turn on the LED light source by turning on-and-off at predetermined intervals the switching element. By performing PWM (pulse width modulation) control, the LED driving device performs the dimming control for the LED light source. The PWM control is performed by changing the on-duty ratio of the PWM signal corresponding to the occupied ratio of the time period during which the switching element is turned on with respect to a predetermined period.

SUMMARY

Meanwhile, the LED driving device as described in JP-A-2009-123681 has the following problems.

Since the current flowing through the LED light source is in a pulsed state, when the dimming degree is deep, that is, when it is dark, there is a possibility that light from the LED light source flashes and flicker occurs.

Further, when performing the dimming control by causing the pulsed current to flow to the LED light source, there is a limit to the reduction in the variable-step of the pulse width of the current. Therefore, it is difficult to perform a fine adjustment to the dimming control. In other words, it is difficult to perform a gradual variable-control.

In view of the above, this disclosure provides at least an LED driving device and a lighting device capable of a fine dimming control even in dark range where the dimming degree is deep.

An LED driving device in one aspect of this disclosure performs a dimming operation of an LED module according to a dimming instruction signal, and the device comprises a dimming controller that receives the dimming instruction signal and generates a dimming signal according to the dimming instruction signal; and a driving circuit that supplies an output current to the LED module based on the dimming signal generated by the dimming controller, wherein the driving circuit unit includes: a converter controller that generates a drive signal based on the dimming signal and outputs the drive signal to a first switching element; a first current setting circuit that is connected between the first switching element and a ground; and a second current setting circuit that is connected in parallel to the first current setting circuit, and wherein the dimming controller controls an operating state of the second current setting circuit to switch an adjustment range of the output current in response to the dimming signal and a change characteristic of the output current in response to the dimming signal.

In the above-described LED driving device, the adjustment range of the output current may become a first output current adjustment range when the operating state of the second current setting circuit is set to an ON state by the dimming controller, and the adjustment range of the output current may become a second output current adjustment range when the operating state of the second current setting circuit is set to an OFF state by the dimming controller.

In the above-described LED driving device, when the adjustment range of the output current is the first output current adjustment range, the dimming controller may: decrease a magnitude of the dimming signal and sets an operating state of the second current setting circuit to an OFF state when the magnitude of the dimming signal reaches a first predetermined value; and switch the magnitude of the dimming signal to the upper limit value within a first predetermined time from a time point when the operating state of the second current setting circuit is switched to the OFF state, so that the adjustment range of the output current shifts to the second output adjustment range.

In the above-described LED driving device, the first predetermined time may be a maximum time period where a flicker of light emitted from the LED module is not sensed.

In the above-described LED driving device, when the adjustment range of the output current is the second output current adjustment range, the dimming controller may: increase a magnitude of the dimming signal to an upper limit value and switches the magnitude of the dimming signal to a second predetermined value when the magnitude of the dimming control signal reaches the upper limit value; and set the operating state of the second current setting circuit to the ON state within a second predetermined time period from a time point when switching to the second predetermined value is performed, so that the adjustment range of the output current to the first output current adjustment range.

In the above-described LED driving device, the second predetermined time period may be the maximum time period where a flicker of light emitted from the LED module is not sensed.

In the above-described LED driving device, the dimming signal may be a PWM (pulse width modulation) signal, and the magnitude of the dimming signal may corresponds to an on-duty value of the PWM signal.

In the above-described LED driving device, the dimming signal may be a DC signal, and the magnitude of the dimming signal may correspond to a voltage value of the DC signal.

In the above-described LED driving device, the first current setting circuit includes a first resistance element, and the second current setting circuit includes a series circuit including at least a second resistance element and a second switching element. The dimming controller controls an operation of the second current setting circuit by controlling turning on-and-off of the second switching element according to a control signal.

A lighting device of this disclosure may comprises: an LED module including one or more LEDs; the above-described LED driving device that drives the LED module; and a dimming control device that outputs the dimming instruction signal to the LED driving device.

Accordingly, by controlling the operating state of the second current setting circuit, the dimming controller switches the adjustment range of the output current relative to the dimming signal and the change characteristic of the output current relative to the dimming signal. Therefore, it is possible to provide the LED driving device and the lighting device capable of a fine dimming control even in dark range that the dimming degree is deep.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, a lighting device using an LED driving device according to illustrative embodiments of this disclosure will be described.

(First Illustrative Embodiment)

Figure 1:
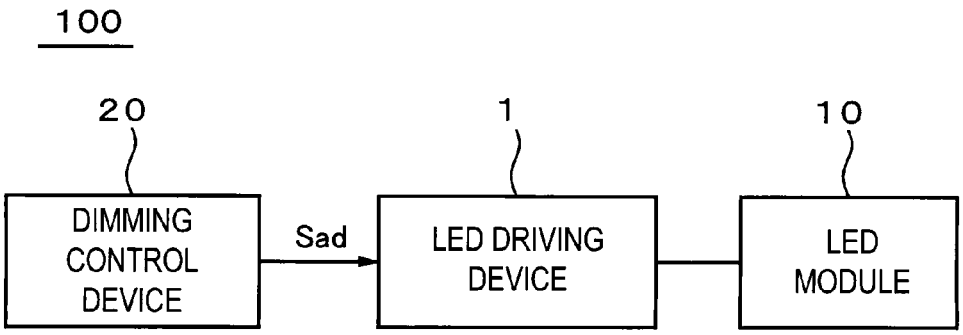
FIG. 1 is a block diagram illustrating a configuration of a lighting device using an LED driving device according to a first illustrative embodiment of this disclosure.

FIG. 1 is a block diagram illustrating a configuration of a lighting device using an LED driving device according to a first illustrative embodiment of this disclosure As shown in FIG. 1, the lighting device 100 includes an LED driving device 1, an LED module 10, and a dimming control device 20. The lighting device 100 performs lighting by driving and turning on the LED module 10.

The LED driving device 1 is connected to the LED module 10. The LED driving device 1 drives the LED module 10.

In this illustrative embodiment, the LED driving device 1 is connected to the dimming control device 20. The dimming control device 20 outputs a dimming instruction signal Sad to the LED driving device 1. The LED driving device 1 performs the dimming operation of the LED module 10, based on the dimming instruction signal Sad from the dimming control device 20 of the external. That is, in the lighting device 100, the brightness of lighting can be changed by the LED module 10.

The dimming instruction signal Sad is, for example, a digital signal. Specifically, for example, it is two kinds of signals instructing a dimming reduction or a dimming increase.

The dimming control device 20 is, for example, a remote controller that is provided with the lighting device 100 to change brightness thereof. The connection between the dimming control device 20 and the LED driving device 1 may be made by wire or by radio. In the case where the dimming control device 20 and the LED driving device 1 is connected by the radio, a light emitting portion may be provided in the dimming control device 20, a light receiving portion may be provided in the LED driving device 1, and it may be configured so that infrared communication may be performed therebetween.

Figure 2:
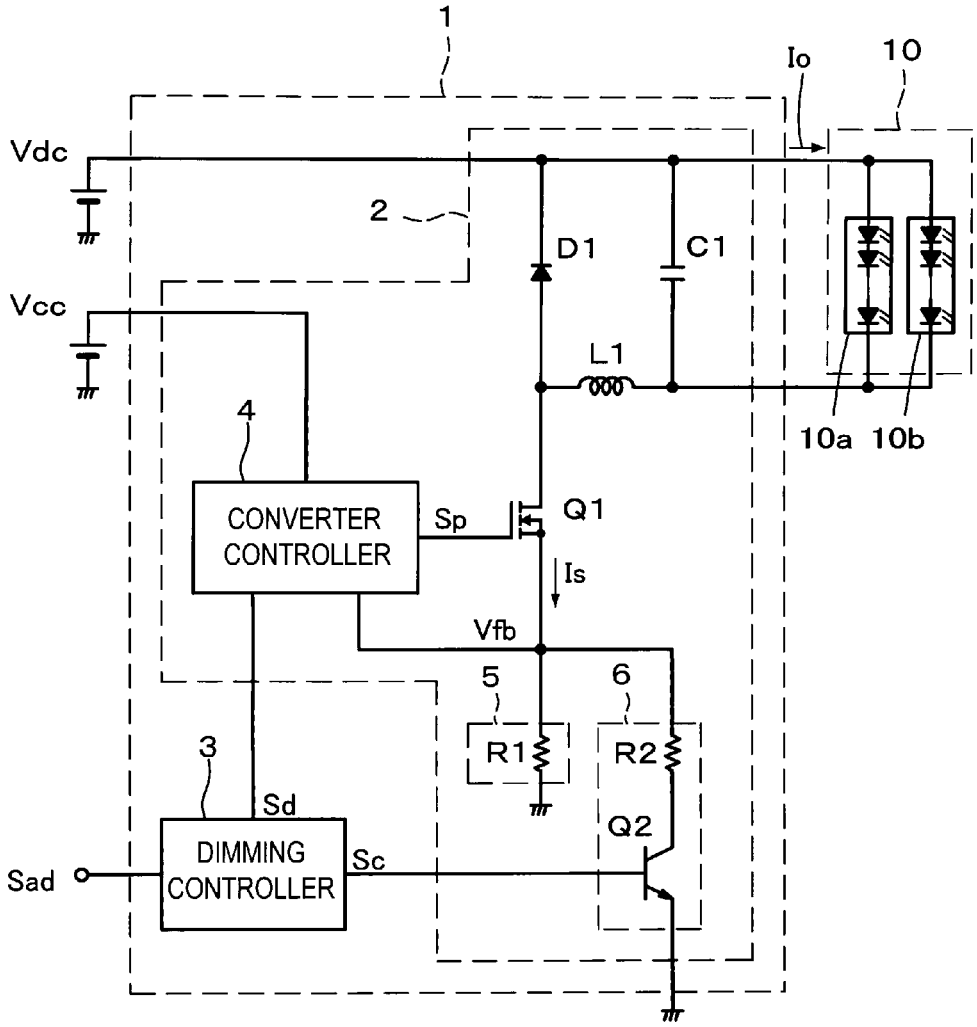
FIG. 2 is a block diagram illustrating a configuration of the LED driving device and an LED module according to the first illustrative embodiment.

FIG. 2 is a block diagram illustrating the configuration of the LED driving device 1 and the LED module 10 according to the first illustrative embodiment.

As shown in FIG. 2, in this illustrative embodiment, the LED module 10 has LED units 10*a* and 10*b* formed by connecting a plurality of LEDs in series. The LED module 10 includes LED units 10*a* and 10*b*, which are connected in parallel to each other.

The LED module 10 is not limited to two LED units 10*a* and 10*b*, but may be provided with further many units. For example, the LED module 10 may be formed with three or more LED units 10*a*, 10*b* and further LED units, which are connected in parallel. The LED units 10*a* and 10*b* may not be limited to those having a plurality of LEDs, but may have one LED. For example, the LED module 10 may be configured by a plurality of LEDs which are connected in parallel to each other one by one. The LED module 10 may be one LED unit having one or more LEDs.

The LED driving device 1 includes a step-down converter circuit unit 2 (an example of a driving circuit) and a dimming controller 3. The step-down converter circuit unit 2 performs the supply of driving power to the LED module 10 and the dimming operation for the LED module 10. For example, the dimming controller 3 includes a microcomputer. The dimming controller 3 receives the dimming instruction signal Sad. The dimming controller 3 outputs a dimming signal Sd according to the dimming instruction signal Sad.

The step-down converter circuit unit 2 includes a first switching element Q1 and a converter controller 4, a first current setting circuit 5, and a second current setting circuit 6.

The first switching element Q1 is, for example, a FET (field effect transistor). The drain terminal of the first switching element Q1 is connected to a terminal of the cathode side of the LED module 10 via an inductor L1.

The converter controller 4 receives power from a drive power source Vcc. The converter controller 4 is formed so as to output a drive signal Sp to the gate terminal of the first switching element Q1. The converter controller 4 outputs a drive signal Sp in response to the dimming signal Sd.

The first current setting circuit 5 and the second current setting circuit 6 are connected in parallel between the source terminal of the first switching element Q1 and a ground. The first current setting circuit 5 and the second current setting circuit 6 are connected to the converter controller 4 at the first switching element Q1 side, whereby the converter controller 4 is configured to be input with a feedback voltage Vfb.

The first current setting circuit 5 has, for example, a first resistance element R1. The first resistance element R1 is disposed between the source terminal of the first switching element Q1 and the ground.

The second current setting circuit 6 includes a series circuit of a second resistance element R2 and the second switching element Q2 (e.g., bipolar transistor). The second switching element Q2 is disposed between the second resistance element R2 and the ground. The base terminal of the second switching element Q2 is connected to the dimming controller 3. The dimming controller 3 outputs a current setting control signal Sc (an example of control signal) to the base terminal of the second switching element Q2. The second switching element Q2 performs the on/off operation depending on the current setting control signal Sc.

Meanwhile, a terminal of the anode side of the LED module 10 is connected to the DC power source Vdc. The LED driving device 1 supplies an output current Io to the LED module 10 to drive the LED module 10. The capacitor C1 is disposed between the terminal of the LED module 10 side of the inductor L1 and the power supply line from the DC power source Vdc. Further, the diode D1 is arranged between the terminal of the first switching element Q1 of the inductor L1 and the power supply line from the DC power source Vdc.

[Description of the Operation at the Time of the Dimming]

The converter controller 4 generates a drive signal Sp so that the feedback voltage Vfb corresponds to the dimming signal Sd input from the dimming controller 3, and thus outputs the first drive signal Sp generated to the first switching element Q1. Thus, the converter controller 4 performs a control so that the output current Io at a constant value corresponding to the dimming signal Sd flows in the LED module.

Here, when the LED module 10 is driven in such way, the dimming controller 3 controls the operation state of the second current setting circuit 6 by outputting the current setting control signal Sc. Accordingly, the dimming controller 3 switches the adjustment range of the output current Io relative to the dimming signal Sd and the change characteristics of the output current Io relative to the dimming signal Sd. In the present illustrative embodiment, the dimming controller 3 switches the ON state and the OFF state of the second current setting circuit 6 by switching the ON state and the OFF state of the second switching element Q2.

As described in the above, the operating state of the second current setting circuit 6 is switched between the ON state and the OFF state thereof, thereby the adjustment range of the output current Io is switched from one to the other of the two types of adjustment ranges. That is, when the operation state of the second current setting circuit 6 is set to the ON state by the dimming controller 3, the adjustment range of the output current Io becomes a first output current adjustment range. When the operation state of the second current setting circuit 6 is set to the OFF state by the dimming controller 3, the adjustment range of the output current Io becomes a second output current adjustment range.

In the present illustrative embodiment, when the current setting control signal Sc that is output from the dimming controller 3 is at a high level, the operation state of the current setting circuit 6 becomes the ON state (ON operation). At this time, the first output current adjustment range is set by the first current setting circuit 5 and the second current setting circuit 6. Thus, the adjustment range of the magnitude of the output current Io is determined according to the value of the combined resistance Ro that is set by the first current setting circuit 5 and the second current setting circuit 6.

The detailed description will be follows. That is, the combined resistance value is determined by a first resistance element R1, a second resistance element R2, and an internal resistance of the second switching element Q2. Here, for simplicity of explanation, that the internal resistance value of the second switching element Q2 is regarded as zero and is not considered. In the first output current adjustment range, if the feedback voltage Vfb is set at 0.5V and the maximum value Is1 max of the current Is1 flowing to the ground from the first switching element Q1 is set at 400 mA, the value of the combined resistance Ro is represented by the following equation.

$$\text{(The value of the combined resistance Ro)}=0.5\text{V}/0.4\text{A}=1.25\Omega$$

Here, the relationship of Ro=(R1*R2)/(R1+R2) is established. Therefore, if the resistance value of the first resistance element R1 is 12.5Ω, the resistance value of the second resistance element R2 may be 1.39Ω. At this time, if the adjustment rate of the dimming signal Sd is in the range from 1 to 100 times, the minimum value of the current Is1 becomes 4 mA.

When the current setting control signal Sc that is output from the dimming controller 3 is at a low level, the operation state of the second current setting circuit 6 is turned off. At this time, the second output current adjustment range is set by the first current setting circuit 5. That is, the adjustment range of the magnitude of the output current Io is shifted to the second output current adjustment range by the resistance value set in the first resistance element R1 of the first current setting circuit 5.

Specifically, for example, in the second output current adjustment range, when the resistance value of the first resistance element R1 is 12.5Ω, Is2 max (the maximum value of the current Is2) flowing to ground from the first switching element Q1 may be indicated by the following equation.

$$Is2\text{max}=0.5V/12.5\Omega=40\text{ mA}$$

This value (40 mA) matches the value at the time that the output current is 40 mA in the first output current adjustment range (when the magnitude of the dimming signal Sd is at a first predetermined value), with respect to the first output current adjustment range.

In the present illustrative embodiment, the dimming signal Sd is, for example, the PWM (pulse width modulation) signal. At this time, the magnitude of the dimming signal Sd corresponds to the on-duty value of the PWM signal. Incidentally, the dimming signal Sd may be, for example, a direct current signal (DC signal). In this case, the magnitude of the dimming signal Sd corresponds to a voltage value of the DC signal.

[Description of Specific Examples of the Dimming Control (The Case of Dimming Reduction (Darken))]

In the case where the adjustment range of the output current Io is the first output current adjustment range, the dimming controller 3 operates as follows so that the dimming control is to be darker. That is, when the magnitude of the dimming signal Sd is reduced from the upper limit of the dimming range to thereby reach a first predetermined value, the operation state of the second current setting circuit 6 is in an OFF state. Then, by switching the magnitude of the dimming signal Sd to the upper limit of the dimming range within a first predetermined time from a time when the operating state of the second current setting circuit has become the OFF state, the adjustment range of the output current Io is shifted to the second output current adjustment range.

Figure 3:
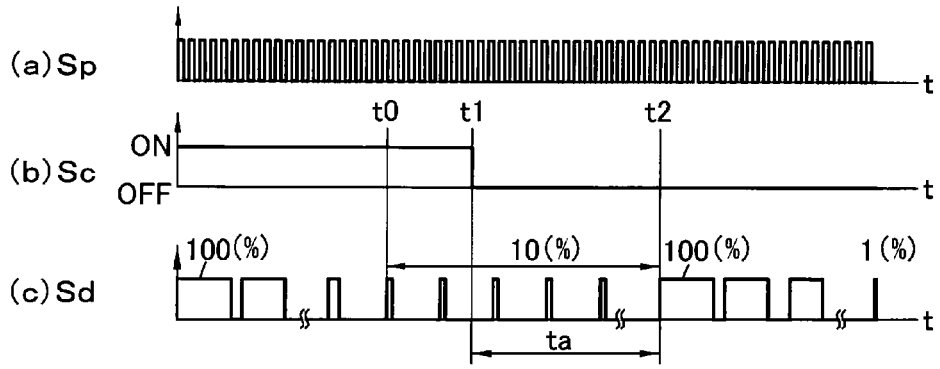
FIG. 3 is a timing chart illustrating an example of each signal waveform when light is darkening in a case where a dimming signal is a PWM signal.

FIG. 3 is a timing chart illustrating an example of each signal waveform when light is darkening in the case where the dimming signal Sd is a PWM signal.

In FIG. 3, the upper chart (a) illustrates the drive signal Sp, the middle chart (b) illustrates the current setting control signal Sc, and the lower chart shown the dimming signal Sd. The same is applied even in the following figures.

In the case where the dimming signal Sd is the PWM signal, the adjustment range of the output current Io is shifted from the first output current adjustment range to the second output current adjustment range, the dimming controller 3 performs a control as follows. Meanwhile, in the present illustrative embodiment, with respect to the on-duty ratio of the dimming signal Sd in the adjustment range of the output current Io, the maximum value (=upper limit) is set at 100%, the first predetermined value is set at 10%, and the minimum value (=lower limit) is set at 1%.

First, in the first output current adjustment range, the dimming controller 3 decreases the on-duty ratio of the dimming signal Sd from the maximum value 100% thereof. At time t0, the on-duty ratio of the dimming signal Sd is set at 10% as a first predetermined value. The current value corresponding to 10% of the first predetermined value in the first output current adjustment range corresponds to the maximum current value of the second output current adjustment range.

Second, after time t0, the dimming controller 3 switches the current setting control signal Sc from a high level to a low level (time t1). Accordingly, it is shifted to the second output current adjustment range.

Third, the dimming controller 3 sets the on-duty ratio of the dimming signal Sd at 100% as a maximum value (time t2), within the predetermined time ta (first predetermined period) from time t1 (figures exactly show a time range after the lapse of a predetermined time ta). This maximum value corresponds to the maximum current value in the second output current adjustment range. Here, the predetermined time ta corresponds to the maximum time period where a user does not sense a flicker of light emitted from the LED module 10 (feel no flicker in the brightness). For example, specifically, the predetermined time ta may be less than 20 ms. The shortest time ta of a predetermined period that can be set is to be one cycle of the dimming signal Sd.

Fourth, after time t2, the dimming controller 3 changes the on-duty ratio of the dimming signal Sd from 100% to 1% (minimum value that can be adjusted) in the second output current adjustment range. Accordingly, the brightness of the LED module 10 is darken until the brightness corresponding to the on-duty ratio 1% of the dimming signal Sd in the second output current adjustment range (dimming is deep).

Figure 4:
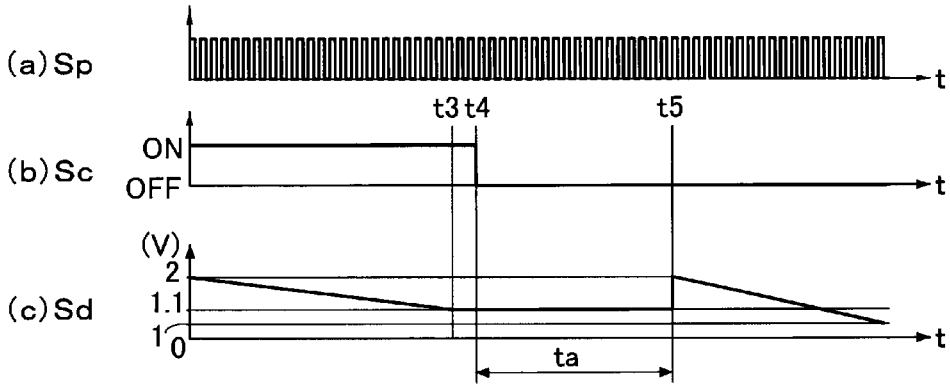
FIG. 4 is a timing chart illustrating an example of each signal waveform when light is darkening in a case where the dimming signal is a DC signal.

FIG. 4 is a timing chart illustrating an example of each signal waveform when light is darkening in the case where the dimming signal Sd is a direct current (DC) signal.

If the dimming signal Sd is a DC signal, when the adjustment range of the output current Io is shifted to the second output current adjustment range from the first output current adjustment range, the dimming controller 3 performs a control in the following order. In the present illustrative embodiment, with respect to the voltage value of the dimming signal Sd in the adjustment range of the output current Io, the maximum value thereof (=upper limit) is set at 2V, the first predetermined value is set at 1.1V, and the minimum value (=lower limit) is set at 1V.

First, in the first output current adjustment range, the dimming controller 3 decreases the voltage value of the dimming signal Sd from the maximum value 2V. At time t3, the voltage value of the dimming signal Sd is set at 1.1V as a first predetermined value. The current value corresponding to 1.1V of the first predetermined value in the first output current adjustment range corresponds to the maximum current value of the second output current adjustment range.

Second, after time t3, the dimming controller 3 switches the current setting control signal Sc from a high level to a low level (time t4). Accordingly, it is shifted to the second output current adjustment range.

Third, the dimming controller 3 sets the voltage value of the dimming signal Sd at 2V as a maximum value (time t5), within the predetermined time ta from time t4 (figures exactly show a time range after the lapse of a predetermined time ta). This maximum value corresponds to the maximum current value in the second output current adjustment range. Here, the predetermined time ta corresponds to the maximum time period where a user does not sense flicker in the brightness (the longest period that flicker is not occurred in the LED module 10). In this example, with respect to the shortest time ta of a predetermined period that can be set, there is no restriction such as the case of using of the PWM signal as described in the foregoing. For this reason, in this example, it is possible to further reduce the predetermined time that can be set.

Fourth, after time t5, the dimming controller 3 changes the voltage value of the dimming signal Sd from 2V to 1V (minimum value that can be adjusted) in the second output current adjustment range. Accordingly, the LED module 10 is darkened until the brightness corresponding to the voltage value 1V of the dimming signal Sd in the second output current adjustment range.

Figure 5:
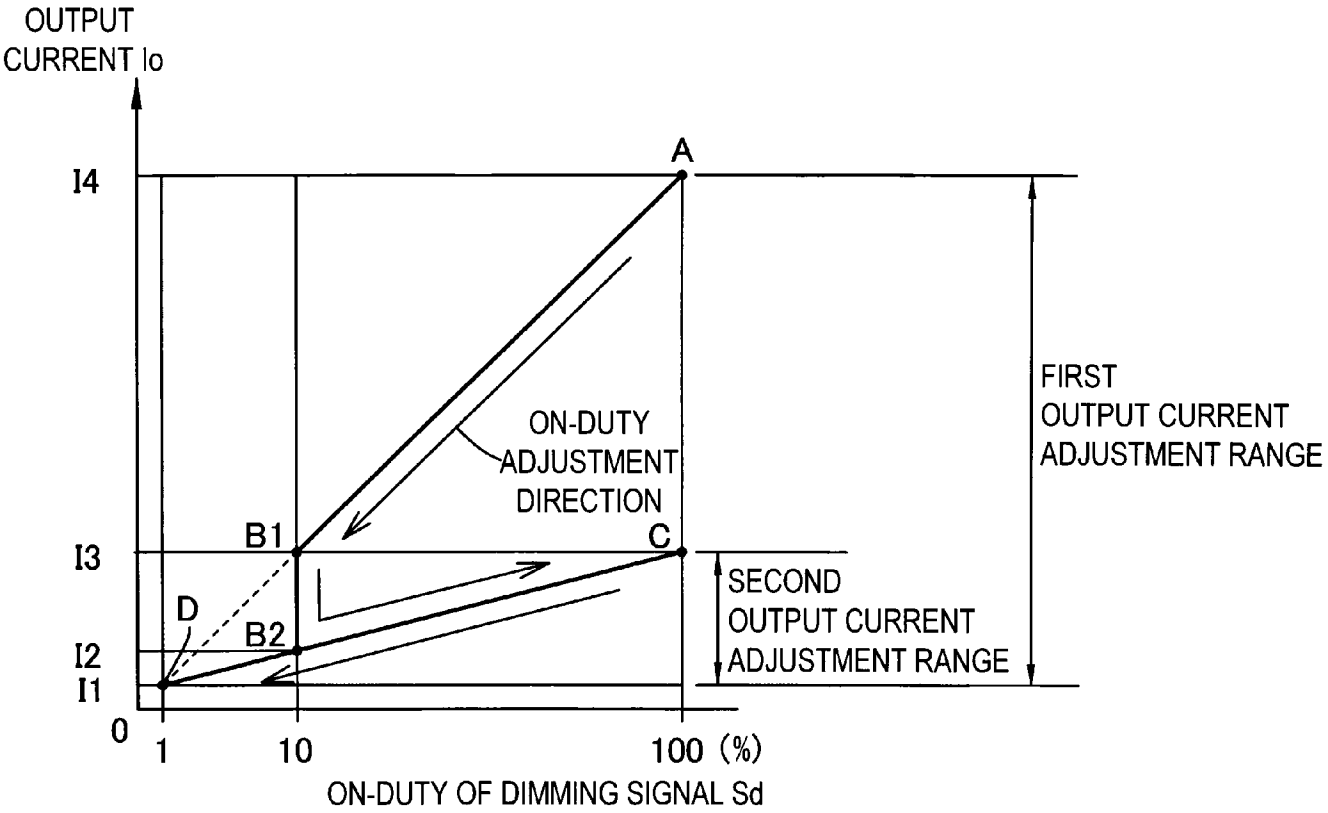
FIG. 5 is a graph illustrating a specific example of the relationship between the dimming signal and the output current when light is darkening in a case where the dimming signal is a PWM signal.

FIG. 5 is a graph illustrating a specific example of the relationship between the dimming signal Sd and the output current Io when light is darkening in the case where the dimming signal Sd is the PWM signal.

In FIG. 5, the first output current adjustment range is a range that the output current Io is I4 to I1. When the second current setting circuit 6 is in the ON operation state, the output current Io is output in this range.

When the second current setting circuit 6 is in the ON operation, if the on-duty ratio of the dimming signal Sd decreases in a straight line towards 1% (the lower limit) from 100% (the maximum value), the output current Io is reduced from I4 to I1, like a line A-D. Here, at a time when the on-duty ratio of the dimming signal Sd reaches 10% as a first predetermined value, the dimming controller 3 turns off the second current setting circuit 6. That is, at the point B1 where the output current is I3, the second current setting circuit 6 is turned off. Then, the dimming controller 3 switches the on-duty ratio of the dimming signal Sd to 100% (upper limit) within the predetermined time ta from this timing (point B1 point B2 point C). Thus, the output current Io becomes the maximum value I3 in the second output current adjustment range.

The second output current adjustment range is a range in which the output current Io is in the range I3 to I1. While the on-duty ratio of the dimming signal Sd is changed to 100% after the second current setting circuit 6 is turned OFF (during the predetermined time ta), the output current Io is reduced momentarily from I3 to I2 marked at point B2. However, since the output current Io returns to I3 in a short time that a user does not sense the flicker of the LED module, it is possible to make the user not feel the decrease in brightness according to the decrease in the output current Io.

As described in the above, after switching to the second output current adjustment range, if the on-duty ratio of the dimming signal Sd is lowered to 1% from 100%, the output current Io may be controlled to decrease slowly from I3 to I1, like a line C-D. That is, in range where the dimming is deep (dark range), it is possible to perform the dimming control more finely.

Accordingly, in the case where light is darkening, the adjustment range of the output current Io is shifted from the first output current adjustment range to the second output current adjustment range, and thus the adjustment range and the change characteristic of the output current Io relative to the dimming signal Sd may be switched. The following effects are obtained.

First, in the deep dimming range in which the on-duty ratio of the dimming signal Sd in the first output current adjustment range is less than a first predetermined value, the adjustment range of the output current Io is switched to the second output current adjustment range. Therefore, in the case of performing the dimming control in the second output current adjustment range, it is possible to perform a fine control for the dimming (gradually lowering the dimming) as compared with the case of performing the dimming control in the first output current adjusting range. That is, in the predetermined range in which the brightness is dark, it is possible to lower the intensity of illumination of the LED module 10 more gradually than a conventional LED module. Thus, for example, in applications of the lighting device, it is possible to finely adjust the intensity of illumination of the LED module 10 stably without flicker. Further, by performing illumination by using the LED module 10, it is possible to produce a fade-out effect more effectively.

Also, switching from the first output current adjustment range to the second output current adjustment range is performed in a short time. Therefore, it is possible to continuously shift into a finely adjustable dimming range without being aware by a user and perform a dimming control in a wide adjustment range.

[Description of a Specific Example of the Dimming Control (Case of Lighting Increase (Brighten))]

In the case where the adjustment range of the output current Io is the second output current adjustment range, the dimming controller 3 operates as follows so that the dimming is to be brighter. That is, when the magnitude of the dimming signal Sd reaches the upper limit value by increasing the magnitude of the dimming signal Sd to the upper limit value from the lower limit value of the dimming range, it switches the magnitude of the dimming signal Sd to a second predetermined value. Then, within the second predetermined time from a time when it performs switching to the second predetermined value, it controls the operating state of the second current setting circuit 6 to be the ON state, thereby shifting the adjustment range of the output current Io to the first output current adjustment range.

Figure 6:
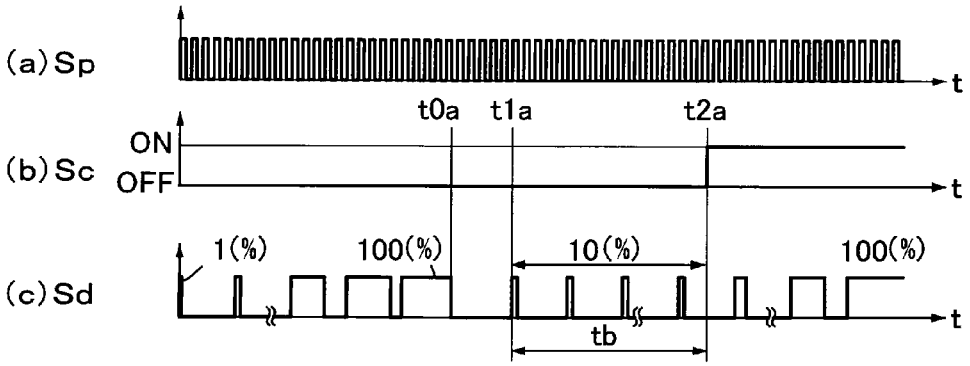
FIG. 6 is a timing chart illustrating an example of each signal waveform when light is brightening in a case where the dimming signal is a PWM signal.

FIG. 6 is a timing chart illustrating an example of each signal waveform when light is brightening in the case where the dimming signal Sd is a PWM signal.

In the case where the dimming signal is the PWM signal, when shifting the adjustment range of the output current Io from the first output current adjustment range to the second output current adjustment range, the dimming controller 3 performs a control in the order of the following. Incidentally, even in the present illustrative embodiment, as in to the foregoing, the maximum value (upper limit value) of the on-duty ratio of the dimming signal Sd is set at 100% and the second predetermined value is set at 10%, and the minimum value is set at 1%, in the adjustment range of the output current Io.

First, in the second output current adjustment range, the dimming controller 3 sets the on-duty ratio of the dimming signal Sd at 100% as the maximum value by increasing it from 1% that is the minimum value thereof. At time t0a, the on-duty ratio of the dimming signal Sd is set at 100% as a maximum value.

Second, after time t0a, the dimming controller 3 sets the on-duty ratio of the dimming signal Sd at 10% (time t1a). The predetermined value 10% of the second output current adjustment range is a value corresponding to the second predetermined value in the first output current adjustment range.

Third, within the predetermined time period (second predetermined time) tb from time t1a (the lapse of the predetermined time period tb is exactly shown in the drawing), the dimming controller 3 switches the current setting control signal Sc from low level to high level (time t2a). Accordingly, it is shifted to the first output current adjustment range. Here, the predetermined time tb corresponds to the maximum time period where a user does not sense flicker with respect to the light emitted from the LED module 10.

Fourth, after time t2a, the dimming controller 3 changes the on-duty ratio of the dimming signal Sd towards 100% from 10%, in the first output current adjustment range. Thus, the LED module 10 is dimming-controlled and brightened.

Figure 7:
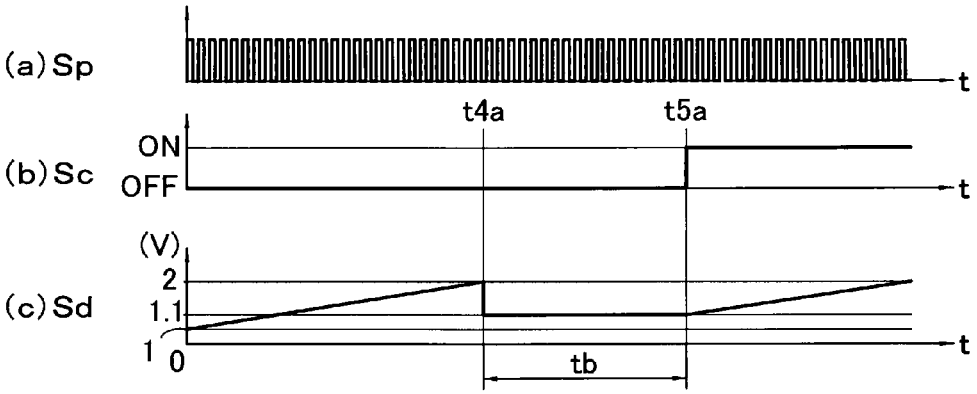
FIG. 7 is a timing chart illustrating an example of each signal waveform when light is brightening in a case where the dimming signal is a DC signal.

FIG. 7 is a timing chart illustrating an example of each signal waveform when light is brightening in a case where the dimming signal is a DC signal.

In the case where the dimming signal Sd is a DC signal, when shifting the adjustment range of the output current Io from the first output current adjustment range to the second output current adjustment range, the dimming controller 3 performs a control in the order of the following. Incidentally, in the present illustrative embodiment, as described above, the maximum value (upper limit value) of the voltage value of the dimming signal Sd is set at 2V, the second predetermined value is set at 1.1V and the minimum value (lower limit value) is set at 1V, in the adjustment range of the output current Io.

First, in the second output current adjustment range, the dimming controller 3 sets the voltage value of the dimming signal Sd at 2V as the maximum value by increasing from 1V as the minimum value thereof (t4a). The maximum value 2V is a voltage value corresponding to the maximum value in the second output current adjustment range.

Second, at the same time as in the foregoing (time t4a), the dimming controller 3 sets the voltage value of the dimming signal Sd at 1.1V which is the second predetermined value. The predetermined value 1V is a voltage value corresponding to the second predetermined value in the first output current adjustment range.

Third, within the predetermined time period (second predetermined time) tb after time t4a (the lapse of the predetermined time period tb is exactly shown in the drawing), the dimming controller 3 switches the current setting control signal Sc from low level to high level (time t5a). Accordingly, it is shifted to the first output current adjustment range.

Fourth, after time t5a, the dimming controller 3 changes the on-duty ratio of the dimming signal Sd towards 100% from 10%, in the first output current adjustment range. Thus, the LED module 10 is dimming-controlled and brightened.

Figure 8:
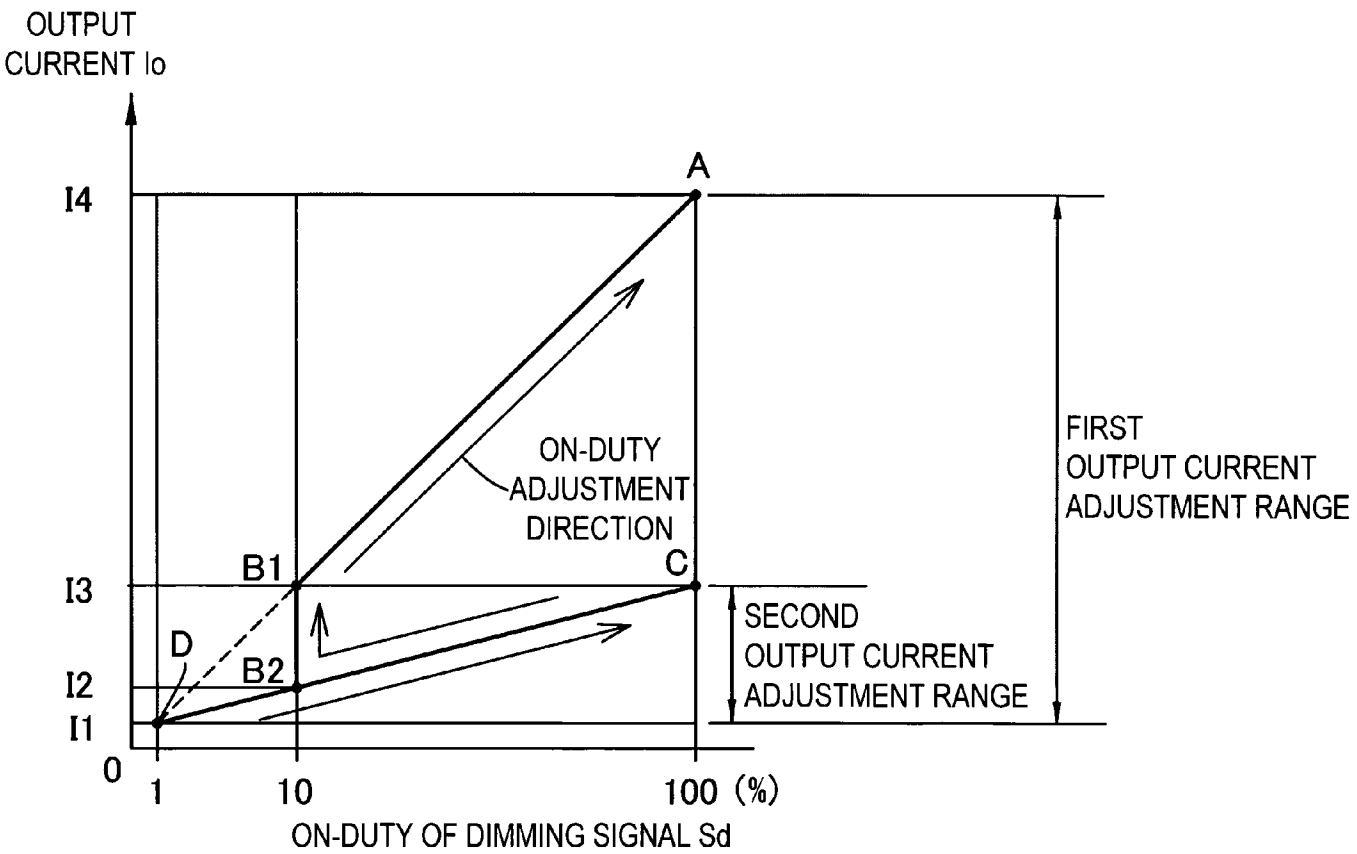
FIG. 8 is a graph illustrating a specific example of the relationship between the dimming signal and the output current when light is brightening in a case where the dimming signal is a PWM signal.

FIG. 8 is a graph illustrating a specific example of the relationship between the dimming signal and the output current when light is brightening in a case where the dimming signal is a PWM signal.

In FIG. 8, the second output current adjustment range is a range where the output current Io is I1 to I3. When the second current setting circuit 6 is in an OFF state, the output current Io is output in this range.

When the second current setting circuit 6 is in an OFF state, the output current Io increases from I1 to I3 (point D C), like line D-C, as the on-duty ratio of the dimming signal Sd is increased linearly from 1% to 100%. Here, at the time point that the on-duty ratio of the dimming signal Sd has reached 100%, the dimming controller 3 sets the on-duty ratio of the dimming signal Sd at 10% as the second predetermined value (point C B2). That is, at the point C where the output current becomes I3, the on-duty ratio of the dimming signal Sd is set to the second predetermined value. Then, the dimming controller 3 controls the second current setting circuit 6 to be in an ON state, within the predetermined time period tb after performing the setting. Thus, the output current Io is switched to I3 from I2 (point B2 B1).

In the state of the second output current adjustment range, by setting the on-duty ratio of the dimming signal Sd at 10% from 100%, the output current Io is temporarily reduced to I2 from I3. However, since a random time period within the maximum time period during which a user does not feel stagnant brightness is set as the predetermined time tb, it is shifted to the first output current adjustment range by turning on the second current setting circuit 6, thereby the output current Io is increased from I2 to I3 immediately. Therefore, even though the output current Io is lowered and the brightness is temporarily lowered, a user does not sense the change in the brightness.

As described in the above, after switching to the first output current adjustment range, if the on-duty ratio of the dimming signal Sd is increased linearly from 10% to 100% like line B1-A, the output current Io can be increased from I3 to I4.

Thus, in the case where light is brightening, the adjustment range of the output current Io is shifted to the first output current adjustment range from the second output current adjustment range, and the adjustment range and the change characteristic of the output current Io relative to the dimming signal Sd is thereby switched. Accordingly, the following effects can be obtained.

First, in the deep dimming range of less than a predetermined value (first predetermined value) of the on-duty ratio of the dimming signal Sd at the first output current adjustment range, the adjustment range of the output current Io is set in the second output current adjustment range. Therefore, it is possible to perform a fine adjustment (gradually increasing the dimming) of the dimming as compared with the case of performing the light dimming in the first output current adjustment range. That is, it is possible to increase the intensity of illumination of the LED module 10 more gradually than a adjustment method to increase the intensity of illumination of a LED module in a conventional art until a predetermined brightness is arrived from a darkened state (e.g., off state). Thus, for example, for use in a lighting device, a fade-in effect can be produced.

Also, switching from the second output current adjustment range to the first output current adjustment is performed in a short time. Therefore, it is possible to continuously switch the deep dimming to the bright dimming so that a user does not sense it, and it is possible to perform the dimming control in a wide adjustment range.

[Second Illustrative Embodiment]

The basic configuration of the LED driving device according to the second illustrative embodiment will not be described here because it is the same as that in the first illustrative embodiment. In the second illustrative embodiment, the configuration of a second current setting circuit differs from that in the first illustrative embodiment.

Figure 9:
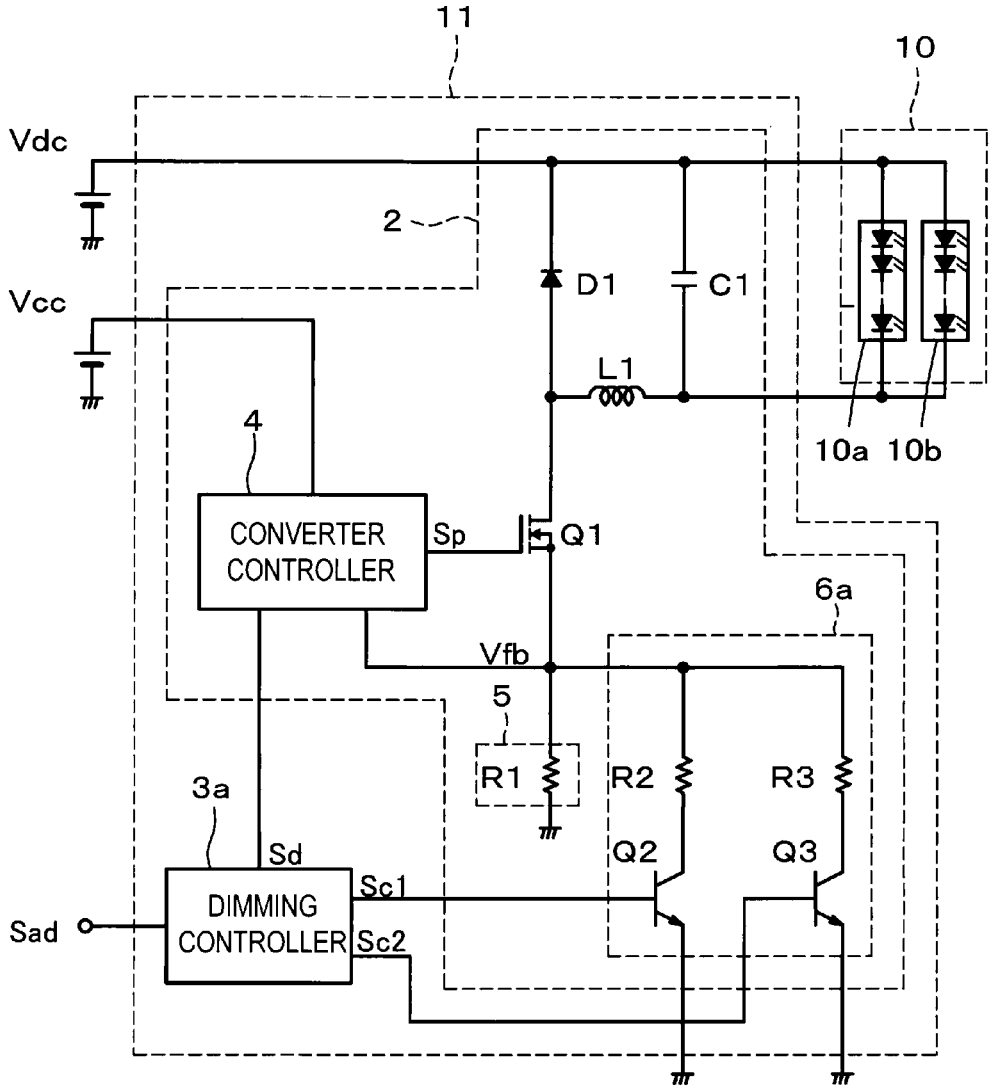
FIG. 9 is a block diagram illustrating a configuration of an LED module and an LED driving device according to a second illustrative embodiment.

FIG. 9 is a block diagram illustrating the configurations of an LED module 10 and an LED driving device 11 according to the second illustrative embodiment.

As shown in FIG. 9, the LED driving device 11 includes a dimming controller 3*a* and a second current setting circuit 6*a*, which are different in its configuration from the dimming controller 3 and the second current setting circuit 6 of the LED driving device 1 of the first illustrative embodiment.

The second current setting circuit 6*a* has a following configuration. That is, it includes a series circuit having a second switching element Q2 and a second resistance element R2, and a series circuit having a third switching element Q3 and a third resistance element R3. These two series circuits are connected in parallel with each other. Each of the second switching element Q2 and the third switching element Q3 is a bipolar transistor.

In the second illustrative embodiment, the base terminal of the second switching element Q2 receives the current setting control signal Sc1 (an example of control signal) outputted from the dimming controller 3*a*. Further, the base terminal of the third switching element Q3 receives the current setting control signal Sc2 (an example of control signal) output from the dimming controller 3*a*.

In the second illustrative embodiment, the dimming controller 3*a* switches between the ON state and OFF state, as needed, with respect to each of the second switching element Q2 and the third switching element Q3. That is, it is possible to perform a control, by which both the second switching element Q2 and the third switching element Q3 are switched to the OFF state or the ON state or any one thereof is switched to the ON state and the other is switched to the OFF state. Thus, in the second illustrative embodiment, it is possible to set the adjustment range of the output current Io in maximum four ways, according to the resistance value of each of the second resistance element R2 and the third resistance element R3.

Thus, in the second illustrative embodiment, it is possible to control an operation state of the second current setting circuit 6*a* in a complex way. Therefore, it is possible to set more finely and as desired, the adjustment range of the output current Io relative to the dimming signal Sd and the change characteristic of the output current Io relative to the dimming signal Sd. Thus, it is possible to vary more freely the intensity of illumination of the LED module 10.

(Others)

The circuit configuration of the second current setting circuit is not limited to those of the first illustrative embodiment and the second illustrative embodiment described above. For example, the number of the series circuits configured by a resistance element and a switching element included in the second current setting circuit is not limited to one or two, but may be more. Further, the switching element included in the second current setting circuit is not limited to the bipolar transistor, but may be, for example, a FET and the like.

Each circuit of the LED driving device may also be configured by using a circuit element that is different from that in the illustrative embodiment described above. For example, the circuit configuration of the step-down converter circuit 2 is not limited to that in the above illustrative embodiments. The dimming controllers 3 and 3*a* are not limited to the microcomputer. The configuration of the driving circuit unit and the configuration of the power source are not limited to the above illustrative embodiments. For example, the AC-DC converter and AC power source may be combined. The LED driving device may be provided with other circuits, in addition to the circuit as described above.

The upper limit value, predetermine value, lower limit value of the dimming range of the dimming signal Sd are not limited to the values according to the present illustrative embodiment. That is, the values represented in the above illustrative embodiments are merely examples for illustration, but may be set appropriately with appropriate values.

The LED driving device according to this disclosure is not limited to those used in the lighting device for illuminating the space. For example, the LED driving device according to this disclosure may be used in a lighting device used as a backlight for various devices. Further, this disclosure is applicable to various devices such as an apparatus radiating light for a particular application using LEDs, or an apparatus displaying and transmitting information with light itself radiated by LED, etc.

The processing, where the dimming controller in the above illustrative embodiment is performed, may be performed by software or may be performed using a hardware circuit.

It is also possible to provide a program for executing the process in the above illustrative embodiment, and the program may be provided to a user by recording it on recording media such as CD-ROM, flexible disk, hard disk, ROM, RAM, memory card, etc. The program may be downloaded to a device through a communication line such as the Internet and the like. The processes explained in the above-described illustrative embodiment are executed by a CPU and the like according to the program.

It should be understood that the above illustrative embodiments are given by way of illustration only, and thus are not limitative of this disclosure in all respects.

What is claimed is:

1. An LED (light emitting diode) driving device that performs a dimming operation of an LED module according to a dimming instruction signal, the device comprising:

a dimming controller that receives the dimming instruction signal and generates a dimming signal according to the dimming instruction signal; and a driving circuit that supplies an output current to the LED module based on the dimming signal generated by the dimming controller, wherein the driving circuit unit includes:

a converter controller that generates a drive signal based on the dimming signal and outputs the drive signal to a first switching element;

a first current setting circuit that is connected between the first switching element and a ground; and a second current setting circuit that is connected in parallel to the first current setting circuit, and wherein the dimming controller controls an operating state of the second current setting circuit to switch an adjustment range of the output current in response to the dimming signal and a change characteristic of the output current in response to the dimming signal, wherein the adjustment range of the output current becomes a first output current adjustment range when the operating state of the second current setting circuit is set to an ON state by the dimming controller, and wherein the adjustment range of the output current becomes a second output current adjustment range when the operating state of the second current setting circuit is set to an OFF state by the dimming controller.

2. The LED driving device according to claim 1, wherein when the adjustment range of the output current is the first output current adjustment range, the dimming controller:

decreases a magnitude of the dimming signal and sets an operating state of the second current setting circuit to an OFF state when the magnitude of the dimming signal reaches a first predetermined value; and switches the magnitude of the dimming signal to the upper limit value within a first predetermined time from a time point when the operating state of the second current setting circuit is switched to the OFF state, so that the adjustment range of the output current shifts to the second output adjustment range.

3. The LED driving device according to claim 2, wherein the first predetermined time is a maximum time period where a flicker of light emitted from the LED module is not sensed.

4. The LED driving device according to claim 1, wherein, when the adjustment range of the output current is the second output current adjustment range, the dimming controller:

increases a magnitude of the dimming signal to an upper limit value and switches the magnitude of the dimming signal to a second predetermined value when the magnitude of the dimming control signal reaches the upper limit value; and sets the operating state of the second current setting circuit to the ON state within a second predetermined time period from a time point when switching to the second predetermined value is performed, so that the adjustment range of the output current to the first output current adjustment range.

5. The LED driving device according to claim 4, wherein the second predetermined time period is the maximum time period where a flicker of light emitted from the LED module is not sensed.

6. The LED driving device according to claim 1, wherein the dimming signal is a PWM (pulse width modulation) signal, and wherein the magnitude of the dimming signal corresponds to an on-duty value of the PWM signal.

7. The LED driving device according to claim 1, wherein the dimming signal is a DC signal, and the magnitude of the dimming signal corresponds to a voltage value of the DC signal.

8. The LED driving device according to claim 1, wherein the first current setting circuit includes a first resistance element, wherein the second current setting circuit includes a series circuit including at least a second resistance element and a second switching element, and wherein the dimming controller controls an operation of the second current setting circuit by controlling turning on-and-off of the second switching element according to a control signal.

9. A lighting device comprising:

an LED module including one or more LEDs;

the LED driving device that drives the LED module according to claim 1; and a dimming control device that outputs the dimming instruction signal to the LED driving device.

* * * * *